US006342472B1

(12) United States Patent
Legel et al.

(10) Patent No.: US 6,342,472 B1
(45) Date of Patent: Jan. 29, 2002

(54) LOW-CONCENTRATION HIGHLY VISCOUS LIQUID DETERGENTS

(75) Inventors: Dieter Legel, Solingen; Josef Penninger, Hilden; Theodor Voelkel, Erkrath, all of (DE)

(73) Assignee: Henkel Kommanditgesellschaft Auf Aktien (KGaA), Duesseldorf (DE)

( * ) Notice: Subject to any disclaimer, the term of this patent is extended or adjusted under 35 U.S.C. 154(b) by 0 days.

(21) Appl. No.: 09/555,147

(22) PCT Filed: Nov. 17, 1998

(86) PCT No.: PCT/EP98/07344

§ 371 Date: Aug. 15, 2000

§ 102(e) Date: Aug. 15, 2000

(87) PCT Pub. No.: WO99/28430

PCT Pub. Date: Jun. 10, 1999

(30) Foreign Application Priority Data

Nov. 26, 1997 (DE) ..... 197 52 163

(51) Int. Cl.[7] ..... C11D 3/37; C11D 7/10
(52) U.S. Cl. ..... 510/345; 510/475
(58) Field of Search ..... 510/475, 345

(56) References Cited

U.S. PATENT DOCUMENTS

| | | | | |
|---|---|---|---|---|
| 3,234,258 A | | 2/1966 | Morris | |
| 4,201,824 A | | 5/1980 | Violland et al. | 428/262 |
| 4,664,839 A | | 5/1987 | Rieck | |
| 4,820,439 A | | 4/1989 | Rieck | |
| 5,073,285 A | * | 12/1991 | Liberati et al. | 252/94 |
| 5,075,041 A | | 12/1991 | Lutz | |
| 5,356,607 A | | 10/1994 | Just | |
| 5,417,951 A | | 5/1995 | Just | |
| 5,691,292 A | * | 11/1997 | Marshall et al. | 510/221 |
| 5,780,420 A | | 7/1998 | Breuer et al. | |
| 6,184,188 B1 | * | 2/2001 | Severns et al. | 510/101 |

FOREIGN PATENT DOCUMENTS

| | | |
|---|---|---|
| DE | 44 00 024 | 7/1995 |
| EP | 0 164 514 | 12/1985 |
| EP | 0 381 262 | 8/1990 |
| EP | 0 659 874 | 6/1995 |
| EP | 0 691 399 | 1/1996 |
| EP | 0 724 013 | 7/1996 |
| EP | 0 786 516 | 7/1997 |
| FR | 1 156 513 | 5/1958 |
| GB | 839407 | 6/1960 |
| GB | 873214 | 7/1961 |
| JP | 58-217598 | 12/1983 |
| JP | 4-332798 | 11/1992 |
| WO | WO 90/13533 | 11/1990 |
| WO | WO 91/08171 | 6/1991 |
| WO | WO 93/21299 | 10/1993 |
| WO | WO 94/29428 | 12/1994 |
| WO | WO 95/07331 | 3/1995 |
| WO | WO 96/01305 | 1/1996 |

* cited by examiner

*Primary Examiner*—John Hardee
(74) *Attorney, Agent, or Firm*—Wayne C. Jaeschke; Glenn E. J. Murphy

(57) ABSTRACT

Low-concentration, highly viscous liquid detergents which maintain their degree of viscosity in storage in a range of climatic conditions, do not undergo any phase separation or agglomerate separation, and maintain their color under the influence of light. Liquid detergents with the desired properties contain 0.2 to 5 wt. % of a polyurethane or modified polyacrylate, 0.5 to 7 wt. % of a boron compound and 1 to 8 wt. % of a complexer.

30 Claims, No Drawings

LOW-CONCENTRATION HIGHLY VISCOUS LIQUID DETERGENTS

The present invention relates to low-concentration, highly viscous liquid detergents which, as a result of using a thickening system, are storage- and viscosity-stable under very diverse climatic conditions, do not undergo phase separation, and have color stability even on exposure to light.

Highly viscous detergents and cleaners, and also cosmetics have been increasingly offered in recent years, those products having a "gel"-like consistency being widely accepted by the consumer. In the field of liquid detergents, highly viscous gel products have the advantage that fewer nonaqueous solvents can be used and the product can be applied in a targeted manner to stains without running. In this connection, conventional liquid detergents are customarily converted into highly viscous products by the use of thickening agents, such as agar agar, carrageen, tragacanth, gum arabic, alginates, pectins, polyoses, guar flour, carob seed grain, starch, dextrins, gelatin, casein, carboxymethylcellulose and also cellulose ethers, hydroxyethyl- and -propylcellulose and the like, seed grain ethers, polyacrylic and polymethacrylic compounds, vinyl polymers, polycarboxylic acids, polyethers, polyimines, polyamides, polysilicic acids, clay minerals, such as montmorillonites, zeolites and silicas. The use of these thickeners for increasing the viscosity in a very wide variety of liquids has belonged to the prior art for some time. The use of polymers in liquid detergents is also well-known.

The incorporation of said thickeners in cases of liquid detergents only leads to stable gels above certain surfactant contents. A gel will usually only form at surfactant contents above 35% by weight. Liquid detergents with surfactant contents below 35% by weight exhibit, after a few days, phase separation or agglomerate formation, which is evident from the formulation becoming opaque ("cloud formation"). Additionally, the viscosity of such products sometimes drops drastically during storage. Since highly viscous liquid detergents are usually offered in transparent bottles to highlight the esthetic features, it is also a requirement that the thickeners used are stable toward light since otherwise free-radical decomposition of the polymers arises, which manifests itself in the destruction of the product color and undesired "cloud formation".

Liquid detergents with viscosities between 500 and 20,000 mPas, preferably from 2000 to 10,000 mPas, in which lamellar surfactant droplets are dispersed in an aqueous electrolyte phase, are described in European Patent Application EP-A 691 399 (Colgate). These compositions comprise 10 to 45% by weight of surfactant(s), at least one builder, and 0.01 to 5% by weight of a mercapto-terminally-capped polymer having an average molecular weight between 1500 and 50,000 $gmol^{-1}$.

The use of boron compounds in aqueous liquid detergents is described in EP-A 381 262 (Unilever). These liquid detergents comprise the boron compounds, and a polyol as enzyme-stabilizing system for a mixture of proteolytic and lipolytic enzymes, preferred stabilizing systems consisting of a sorbitol/borax mixture. Information about viscosity and stability of the liquid detergents is not given in this specification.

Liquid, aqueous detergent concentrates which retain or increase their viscosity upon dilution with water are described in EP-A 724 013 (Colgate). This effect is achieved by the use of two surfactants having varying stability toward electrolytes and the addition of a dissolved electrolyte, where the concentrate has a viscosity of less than 2500 mPas and, upon dilution with water, loses its micellar structure at the expense of the formation of a lamellar phase.

The International Patent Application WO 96/01305 (Unilever) describes an aqueous cleaner and liquid detergent which, upon dilution with at least twice the amount of water, forms a microemulsion which has particle sizes from 10 to 100 nm. The composition comprises 20 to 70% by weight of water, 15 to 40% by weight of a surfactant system which comprises at least one nonionic surfactant from the group of alkoxylated alcohols and not more than 20% by weight of anionic, cationic, amphoteric or zwitterionic surfactants, 5 to 30% by weight of solvents and 5 to 20% by weight of water-insoluble oil.

None of said specifications deals with the problem of providing low-concentration and highly viscous liquid detergents which guarantee a stable viscosity, do not lead to agglomerate formation (so-called "cloud formation") or phase separation, and do not have a decrease in color stability on exposure to light. The solution to this problem was the object of the present invention.

It has now been found that liquid detergents with said profile of properties can be prepared if a thickening system comprising polyurethanes or modified polyacrylates, a boron compound and complexing agents is incorporated into the compositions.

The present invention therefore provides aqueous, highly viscous liquid detergents comprising surfactant(s) and other customary ingredients of detergents and cleaners, where the compositions comprise, as thickening system, in each case based on the total composition, a) 0.2 to 5% by weight of a polyurethane or a modified polyacrylate, b) 0.5 to 7% by weight of a boron compound, and c) 1 to 8% by weight of a completing agent.

By using the thickening system according to the invention it is possible to prepare highly viscous liquid detergents which are free from said disadvantages. According to the invention, it is possible also to prepare concentrated highly viscous liquid detergents which have surfactant contents above 35% by weight. Since, however, said problems arise particularly in the case of low-concentration products, for the purposes of the present invention, preference is given to aqueous, highly viscous liquid detergents whose content of surfactant(s) is below 30% by weight.

The first component of the thickening system is a polyurethane or a modified polyacrylate which, based on the total composition, is used in amounts of from 0.2 to 5% by weight.

Polyurethanes (PUR) are prepared by polyaddition from di- and polyhydric alcohols and isocyanates and can be described by the general formula I

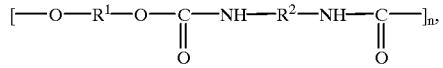

I in which $R^1$ is a low molecular weight or polymeric diol radical, $R^2$ is an aliphatic or aromatic group, and n is a natural number. $R^1$ is preferably a linear or branched $C_{2-12}$-alk(en)yl group, but can also be a radical of a polyhydric alcohol, by means of which crosslinked polyurethanes are formed which differ from the formula I given above by virtue of the fact that further —O—CO—NH groups are bonded to the radical $R^1$.

Industrially important PUR are prepared from polyesterdiols and/or polyetherdiols and, for example, from toluene 2,4-diisocyanate or 2,6-diisocyanate (TDI, $R^2=C_6H_3—CH_3$), methylene 4,4'-di(phenylisocyanate) (MDI, $R^2=C_6H_4—CH_2—C_6H_4$) or hexamethylene diisocyanate [HMDI, $R^2=(CH_2)_6$]. Commercially available thickeners based on polyurethane are available, for example, under the names Acrysol® PM 12 V (mixture of 3–5% of modified starch and 14–16% of PUR resin in water, Rohm&Haas), Borchigel® L75-N (nonionogenic PUR dispersion, 50% strength in water, Borchers), Coatex® BR-100-P (PUR dispersion, 50% strength in water/butyl glycol, Dimed), Nopco® DSX-1514 (PUR dispersion, 40% strength in water/butyl triglycol, Henkel-Nopco), thickener QR 1001 (20% strength PUR emulsion in water/diglycol ether, Rohm&Haas) and Rilanit® VPW-3116 (PUR dispersion, 43% strength in water, Henkel).

Preferred liquid detergents comprise 0.2 to 4% by weight, preferably 0.3 to 3% by weight and in particular 0.5 to 1.5% by weight, of a polyurethane.

Modified polyacrylates which can be used for the purposes of the present invention are derived, for example, from acrylic acid or from methacrylic acid, and can be described by the general formula II

II

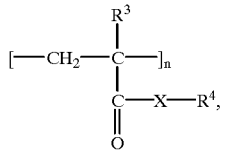

in which $R^3$ is H or a branched or unbranched $C_{1-4}$-alk(en)yl radical, X is N—$R^5$ or O, $R^4$ is an optionally alkoxylated, branched or unbranched, optionally substituted $C_{8-22}$-alk(en)yl radical, $R^5$ is H or $R^4$, and n is a natural number. In general, such modified polyacrylates are esters or amides of acrylic acid or of an α-substituted acrylic acid. Of these polymers, preference is given to those in which $R^3$ is H or a methyl group. In the case of the polyacrylamides (X=N—$R^5$), both mono-N-substituted ($R^5$=H) and also di-N-substituted ($R^5=R^4$) amide structures are possible, it being possible to choose the two hydrocarbon radicals which are bonded to the N atom independently of one another from optionally alkoxylated, branched or unbranched $C_{8-22}$-alk(en)yl radicals. Of the polyacrylic esters (X=O), preference is given to those in which the alcohol has been obtained from natural or synthetic fats or oils and has additionally been alkoxylated, preferably ethoxylated. Preferred degrees of alkoxylation are between 2 and 30, particular preference being given to degrees of alkoxylation between 10 and 15.

Since the polymers which can be used are technical-grade compounds, the designation of the radicals bonded to X is a statistical average value which can vary with regard to chain length or degree of alkoxylation in the individual case. The formula II merely gives formulae for idealized homopolymers. For the purposes of the present invention, however, it is also possible to use copolymers in which the proportion of monomer units which satisfy the formula II is at least 30% by weight. Thus, for example, it is also possible to use copolymers of modified polyacrylates and acrylic acid or salts thereof which still have acidic H atoms or basic —COO— groups.

For the purposes of the present invention, preferred modified polyacrylates are polyacrylate-polymethacrylate copolymers which satisfy the formula IIa IIa

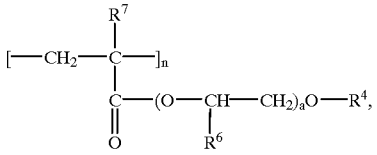

in which $R^4$ is a preferably unbranched, saturated or unsaturated $C_{8-22}$-alk(en)yl radical, $R^6$ and $R^7$ independently of one another are H or $CH_3$, the degree of polymerization n is a natural number, and the degree of alkoxylation a is a natural number between 2 and 30, preferably between 10 and 20. $R^4$ is preferably a fatty alcohol radical which has been obtained from natural or synthetic sources, where the fatty alcohol has in turn preferably been ethoxylated ($R^6$=H).

Products of the formula IIa are commercially available, for example under the name Acusol® 820 (Rohm&Haas) in the form of 30% strength by weight dispersions in water. In said commercial product, $R^4$ is a stearyl radical, $R^6$ is a hydrogen atom, $R^7$ is H or $CH_3$ and the degree of ethoxylation a is 20.

Preferred liquid detergents comprise, based on the total composition, 0.2 to 4% by weight, preferably 0.3 to 3% by weight and in particular 0.5 to 1.5% by weight, of a modified polyacrylate of the formula II.

The second component of the thickening system in the compositions according to the invention is a boron compound, which is used in amounts of from 0.5 to 7% by weight. Examples of boron compounds which can be used for the purposes of the present invention are boric acid, boron oxide, alkali metal borates, such as ammonium, sodium and potassium ortho-, meta- and pyroborates, borax in its various stages of hydration, and polyborates, such as, for example, alkali metal pentaborates. It is also possible to use organic boron compounds, such as esters of boric acid. Preferred liquid detergents comprise 0.5 to 4% by weight, preferably 0.75 to 3% by weight and in particular 1 to 2% by weight, of boric acid or sodium tetraborate.

As the third component of the thickening system, the liquid detergents according to the invention comprise 1 to 8% by weight of a complexing agent. For the purposes of the present application, the term "complexing agents" means low molecular weight hydroxycarboxylic acids, such as citric acid, tartaric acid, malic acid, or gluconic acid or salts thereof.

Particularly preferred liquid detergents comprise, as component c) of the thickening system, citric acid or sodium citrate, preference being given to liquid detergents which comprise 2.0 to 7.5% by weight, preferably 3.0 to 6.0% by weight and in particular 4.0 to 5.0% by weight, of sodium citrate.

In addition to the constituents of the thickening system, the liquid detergents according to the invention comprise surfactant(s), use being made of anionic, nonionic, cationic and/or amphoteric surfactants. From an applications viewpoint, preference is given to mixtures of anionic and nonionic surfactants, where the proportion of anionic surfactants should be greater than the proportion of nonionic surfactants. The total surfactant content of the moldings is, as described above, preferably below 30% by weight, based on the total liquid detergent.

The nonionic surfactants used are preferably alkoxylated, advantageously ethoxylated, in particular primary alcohols having, preferably, 8 to 18 carbon atoms and, on average, 1 to 12 mol of ethylene oxide (EO) per mole of alcohol in which the alcohol radical can be linear or preferably methyl-branched in the 2-position, or can contain linear and methyl-branched radicals in a mixture, as are usually present in oxo alcohol radicals. However, alcohol ethoxylates containing linear radicals of alcohols of native origin having 12 to 18 carbon atoms, e.g. from coconut, palm, tallow fatty or oleyl alcohol, and, on average, 2 to 8 EO per mole of alcohol are particularly preferred. Preferred ethoxylated alcohols include, for example, $C_{12-14}$-alcohols having 3 EO, 4 EO or 7 EO, $C_{9-11}$-alcohol having 7 EO, $C_{13-15}$-alcohols having 3 EO, 5 EO, 7 EO or 8 EO, $C_{12-18}$-alcohols having 3 EO, 5 EO or 7 EO and mixtures of these, for example mixtures of $C_{12-14}$-alcohol having 3 EO and $C_{12-18}$-alcohol having 7 EO. The degrees of ethoxylation given are statistical mean values which can be an integer or a fraction for a specific product. Preferred alcohol ethoxylates have a narrowed homologue distribution (narrow range ethoxylates, NRE). As well as these nonionic surfactants, it is also possible to use fatty alcohols having more than 12 EO. Examples thereof are tallow fatty alcohol having 14 EO, 25 EO, 30 EO or 40 EO. Nonionic surfactants which contain EO and PO groups together in the molecule can also be used according to the invention. In this connection, block copolymers having EO-PO block units or PO-EO block units can be used, but also EO-PO-EO copolymers and PO-EO-PO copolymers. It is of course also possible to use mixed alkoxylated nonionic surfactants in which EO and PO units are not distributed blockwise, but randomly. Such products can be obtained by the simultaneous action of ethylene oxide and propylene oxide on fatty alcohols.

Furthermore, the other nonionic surfactants which may be used are also alkyl glycosides of the general formula $RO(G)_x$, in which R is a primary straight-chain or methyl-branched, in particular methyl-branched in the 2-position, aliphatic radical having 8 to 22, preferably 12 to 18, carbon atoms, and G is the symbol which represents a glycose unit having 5 or 6 carbon atoms, preferably glucose. The degree of oligomerization x, which indicates the distribution of monoglycosides and oligoglycosides, is any number between 1 and 10; x is preferably 1.2 to 1.4.

A further class of preferred nonionic surfactants, which are either used as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain, in particular fatty acid methyl esters, as are described, for example, in Japanese Patent Application JP 58/217598, or which are preferably prepared by the process described in the International Patent Application WO-A-90/13533.

Nonionic surfactants of the amine oxide type, for example N-cocoalkyl-N,N-dimethylamine oxide and N-tallow-alkyl-N,N-dihydroxyethylamine oxide, and the fatty acid alkanolamides may also be suitable. The amount of these nonionic surfactants is preferably not more than that of the ethoxylated fatty alcohols, in particular not more than half thereof.

Other suitable surfactants are polyhydroxy fatty acid amides of the formula III,

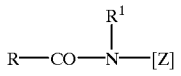

III in which RCO is an aliphatic acyl radical having 6 to 22 carbon atoms, $R^1$ is hydrogen, an alkyl or hydroxyalkyl radical having 1 to 4 carbon atoms, and [Z] is a linear or branched polyhydroxyalkyl radical having 3 to 10 carbon atoms and 3 to 10 hydroxyl groups. The polyhydroxy fatty acid amides are known substances, which can usually be obtained by reductive amination of a reducing sugar with ammonia, an alkylamine or an alkanolamine, and subsequent acylation with a fatty acid, a fatty acid alkyl ester or a fatty acid chloride.

The group of polyhydroxy fatty acid amides also includes compounds of the formula IV,

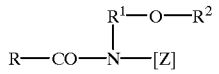

IV in which R is a linear or branched alkyl or alkenyl radical having 7 to 12 carbon atoms, $R^1$ is a linear, branched or cyclic alkyl radical or an aryl radical having 2 to 8 carbon atoms, and $R^2$ is a linear, branched or cyclic alkyl radical or an aryl radical or an oxy-alkyl radical having 1 to 8 carbon atoms, where $C_{1-4}$-alkyl or phenyl radicals are preferred and [Z] is a linear polyhydroxyalkyl radical whose alkyl chain is substituted by at least two hydroxyl groups, or alkoxylated, preferably ethoxylated or propoxylated, derivatives of-this radical.

[Z] is preferably obtained by reductive amination of a sugar, for example glucose, fructose, maltose, lactose, galactose, mannose or xylose. The N-alkoxy- or N-aryloxy-substituted compounds can then be converted into the desired polyhydroxy fatty acid amides, for example in accordance with the teaching of the International Application WO-A-95/07331 by reaction with fatty acid methyl esters in the presence of an alkoxide as catalyst.

The content of nonionic surfactants in preferred liquid detergents is 5 to 20% by weight, preferably 7 to 15% by weight and in particular 9 to 14% by weight, in each case based on the total composition.

The anionic surfactants used are, for example, those of the sulfonate and sulfate type. Suitable surfactants of the sulfonate type are, in this connection, preferably $C_{9-13}$-alkylbenzenesulfonates, olefinsulfonates, i.e. mixtures of alkene and hydroxyalkanesulfonates, and disulfonates, as are obtained, for example, from $C_{12-18}$-monoolefins having a terminal or internal double bond by sulfonation with gaseous sulfur trioxide and subsequent alkaline or acidic hydrolysis of the sulfonation products. Also suitable are alkanesulfonates which are obtained from $C_{12-18}$-alkanes, for example by sulfochlorination or sulfoxidation with subsequent hydrolysis or neutralization. Likewise, the esters of α-sulfo fatty acids (ester sulfonates), e.g. the α-sulfonated methyl esters of hydrogenated coconut, palm kernel or tallow fatty acids are also suitable.

Further suitable anionic surfactants are sulfated fatty acid glycerol esters. Fatty acid glycerol esters mean the mono-, di- and triesters, and mixtures thereof, as are obtained during the preparation by esterification of a monoglycerol with 1 to 3 mol of fatty acid or during the transesterification of triglycerides with 0.3 to 2 mol of glycerol. Preferred sulfated fatty acid glycerol esters are the sulfation products of saturated fatty acids having 6 to 22 carbon atoms, for example of caproic acid, caprylic acid, capric acid, myristic acid, lauric acid, palmitic acid, stearic acid or behenic acid.

Preferred alk(en)yl sulfates are the alkali metal, and in particular the sodium, salts of sulfuric half-esters of $C_{12}$–$C_{18}$-fatty alcohols, for example of coconut fatty alcohol, tallow fatty alcohol, lauryl, myristyl, cetyl or stearyl alcohol or of $C_{10}$–$C_{20}$-oxo alcohols and those half-esters of secondary alcohols of these chain lengths. Further preferred are alk(en)yl sulfates of said chain length which contain a synthetic, petrochemical-base-prepared straight-chain alkyl radical which have an analogous degradation behavior to the adequate compounds based on fat-chemical raw materials. From the point of view of washing, the $C_{12}$–$C_{16}$-alkyl sulfates and $C_{12}$–$C_{15}$-alkyl sulfates and $C_{14}$–$C_{15}$-alkyl sulfates are preferred. 2,3-Alkyl sulfates, which are prepared, for example, according to U.S. Pat. Nos. 3,234,258 or 5,075,041 and can be obtained as commercial products from Shell Oil Company under the name DAN®, are also suitable anionic surfactants.

The sulfuric monoesters of the straight-chain or branched $C_{7-21}$-alcohols, ethoxylated with 1 to 6 mol of ethylene oxide, such as 2-methyl-branched $C_{9-11}$-alcohols with, on average, 3.5 mol of ethylene oxide (EO) or $C_{12-18}$-fatty alcohols with 1 to 4 EO are also suitable. Because of their high foaming behavior, they are used in cleaners only in relatively small amounts, for example in amounts of from 1 to 5% by weight.

Other suitable anionic surfactants are also the salts of alkylsulfosuccinic acid, which are also referred to as sulfosuccinates or as sulfosuccinic esters, and the monoesters and/or diesters of sulfosuccinic acid with alcohols, preferably fatty alcohols and in particular ethoxylated fatty alcohols. Preferred sulfosuccinates comprise $C_{8-18}$-fatty alcohol radicals or mixtures thereof. Particularly preferred sulfosuccinates comprise a fatty alcohol radical derived from ethoxylated fatty alcohols, which are in themselves nonionic surfactants (see below for description). In this connection, sulfosuccinates whose fatty alcohol radicals are derived from ethoxylated fatty alcohols having a narrowed homologue distribution are, in turn, particularly preferred. Likewise, it is also possible to use alk(en)ylsuccinic acid having, preferably, 8 to 18 carbon atoms in the alk(en)yl chain or salts thereof.

Other suitable anionic surfactants are, in particular, soaps. Saturated and unsaturated fatty acid soaps, such as the salts of lauric acid, myristic acid, palmitic acid, stearic acid, (hydrogenated) erucic acid and behenic acid, and, in particular, soap mixtures derived from natural fatty acids, e.g. coconut, palm kernel, olive oil or tallow fatty acids, are suitable.

The anionic surfactants, including soaps, can be present in the form of their sodium, potassium or ammonium salts, and as soluble salts of organic bases, such as mono-, di- or triethanolamine. The anionic surfactants are preferably in the form of their sodium or potassium salts, in particular in the form of the sodium salts.

The content of anionic surfactants in preferred liquid detergents is 5 to 25% by weight, preferably 7 to 22% by weight and in particular 10 to 20% by weight, in each case based on the total composition.

The viscosity of the compositions according to the invention can be measured using customary standard methods (for example Brookfield viscometer LVT-II at 20 rpm and 20° C., spindle 3) and is preferably in the range from 500 to 5000 mpas. Preferred compositions have viscosities of from 1000 to 4000 mPas, values between 1300 and 3000 mPas being particularly preferred.

In addition to the thickening system and to surfactant(s), the compositions according to the invention can comprise further ingredients which further improve the application and/or esthetic properties of the liquid detergent. For the purposes of the present invention, preferred compositions comprise, in addition to the thickening system and to surfactant(s), one or more substances from the group of builders, bleaches, bleach activators, enzymes, electrolytes, nonaqueous solvents, pH regulators, fragrances, perfume carriers, fluorescence agents, dyes, hydrotropic agents, foam inhibitors, silicone oils, antiredeposition agents, optical brighteners, graying inhibitors, shrink preventatives, anticrease agents, dye-transfer inhibitors, antimicrobial active ingredients, germicides, fungicides, antioxidants, corrosion inhibitors, antistats, easy-iron agents, repellent and impregnation agents, swelling and nonslip agents, and UV absorbers.

Builders which may be present in the liquid detergents according to the invention are, in particular, silicates, aluminum silicates (in particular zeolites), carbonates, salts of organic di- and polycarboxylic acids, and mixtures of these substances.

Suitable crystalline, layered sodium silicates have the general formula $NaMSi_xO_{2x+1}.H_2O$, where M is sodium or hydrogen, x is a number from 1.9 to 4, and y is a number from 0 to 20, and preferred values for x are 2, 3 or 4. Such crystalline phyllosilicates are described, for example, in European Patent Application EP-A-0 164 514. Preferred crystalline phyllosilicates of the given formula are those in which M is sodium and x assumes the values 2 or 3. In particular, both β- and also δ-sodium disilicates $Na_2Si_2O_5.yH_2O$ are preferred, where β-sodium disilicate can, for example, be obtained by the process described in International Patent Application WO-A-91/08171.

It is also possible to use amorphous sodium silicates having a $Na_2O:SiO_2$ modulus of 1:2 to 1:3.3, preferably from 1:2 to 1:2.8 and in particular from 1:2 to 1:2.6, which have delayed dissolution and secondary detergent properties. The dissolution delay compared with traditional amorphous sodium silicates can have been induced in a variety of ways, for example by surface treatment, compounding, compacting/compression or by overdrying. For the purposes of this invention, the term "amorphous" also includes "X-ray amorphous". This means that in X-ray diffraction experiments the silicates do not give sharp X-ray reflections typical of crystalline substances, but instead exhibit, at best, one or more maxima of the scattered X-rays having a width of several degree units of the diffraction angle. However, particularly good builder properties can result if in electron diffraction experiments the silicate particles give poorly defined or even sharp diffraction maxima. This is to be interpreted to the effect that the products have microcrystalline regions with a size ranging from 10 to a few hundred nm, preference being given to values up to at most 50 nm and in particular up to at most 20 nm. So-called X-ray amorphous silicates of this kind, which likewise have delayed dissolution compared to conventional waterglasses, are described, for example, in German Patent Application DE-A-44 00 024. Particular preference is given to compressed/compacted amorphous silicates, compounded amorphous silicates and overdried X-ray amorphous silicates.

The finely crystalline, synthetic zeolite used, containing bound water, is preferably zeolite A and/or P. Zeolite P is particularly preferably zeolite MAP® (commercial product from Crosfield). Also suitable, however, are zeolite X, and mixtures of A, X and/or P. A co-crystallizate of zeolite X and zeolite A (about 80% by weight of zeolite X), which is sold by CONDEA Augusta S.p.A. under the trade name VEGO-BOND AX® and can be described by the formula $$nNa_2O.(1-n)K_2O.Al_2O_3.(2–2.5)SiO_2.(3.5–5.5)H_2O$$

is, for example, also commercially available and preferred for the purposes of the present invention. The zeolite can be used as a spray-dried powder or else as an undried, stabilized suspension still moist from its preparation. If the zeolite is employed as a suspension, this suspension may comprise small additions of nonionic surfactants as stabilizers, for example 1 to 3% by weight, based on zeolite, of ethoxylated $C_{12}$–$C_{18}$-fatty alcohols having 2 to 5 ethylene oxide groups, $C_{12}$–$C_{14}$-fatty alcohols having 4 to 5 ethylene oxide groups or ethoxylated isotridecanoles. Suitable zeolites have a mean particle size of less than 10 $\mu$m (volume distribution; measurement method: Coulter Counter) and preferably contain 18 to 22% by weight, in particular 20 to 22% by weight, of bound water.

It is of course also possible to use the generally known phosphates as builder substances, provided such a use must not be avoided for ecological reasons. The sodium salts of the orthophosphates, the pyrophosphates and, in particular, of the tripolyphosphates are particularly suitable.

Among the compounds used as bleaches which donate $H_2O_2$ in water, sodium perborate tetrahydrate and sodium perborate monohydrate are of particular importance. Other bleaches which can be used are, for example, sodium percarbonate, peroxypyrophosphates, citrate perhydrates, and $H_2O_2$-donating peracidic salts or peracids, such as perbenzoate, peroxophthalates, diperazelaic acid, phthaloimino peracid or diperdodecanedioic acid.

In order to achieve an improved bleaching effect when washing at temperatures of 60° C. and below, bleach activators can be incorporated into the detergent and cleaner moldings. Bleach activators which can be used are compounds which, under conditions of perhydrolysis, give aliphatic peroxocarboxylic acids having, preferably, 1 to 10 carbon atoms, in particular 2 to 4 carbon atoms, and/or optionally substituted perbenzoic acid. Suitable substances are those which carry O -and/or N-acyl groups of the stated carbon number and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acyl imides, in particular N-nonanoylsuccinimide (NOSI), acylated phenolsulfonates, in particular n-nonanoyl- or isononanoyloxybenzenesulfonate (n- and iso-NOBS respectively), carboxylic anhydrides, in particular phthalic anhydride, acylated polyhydric alcohols, in particular triacetin, ethylene glycol diacetate and 2,5-diacetoxy-2,5-dihydrofuran.

In addition to, or instead of, the conventional bleach activators, it is also possible to incorporate so-called bleaching catalysts into the moldings. These substances are bleach-reinforcing transition metal salts or transition metal complexes such as, for example, Mn, Fe, Co, Ru or Mo salen complexes or carbonyl complexes. Mn, Fe, Co, Ru, Mo, Ti, V and Cu complexes with nitrogen-containing tripod ligands, and Co, Fe, Cu and Ru ammine complexes can also be used as bleaching catalysts.

Suitable enzymes are, in particular, those from the classes of hydrolases, such as the proteases, esterases, lipases and lipolytic enzymes, amylases, cellulases and other glycosyl hydrolases and mixtures of said enzymes. During washing, all of these hydrolases contribute to the removal of marks, such as protein-, grease- or starch-containing marks, and grayness. Moreover, cellulases and other glycosyl hydrolases may, by removing pilling and microfibrils, contribute to color retention and to an increase in the softness of the textile. For bleaching or for inhibiting color transfer it is also possible to use oxireductases. Particularly suitable enzymatic active ingredients are those obtained from bacterial strains or fungi, such as Bacillus subtilis, Bacillus licheniformis, Streptomyceus griseus and Humicola insolens. Preference is given to using proteases of the subtilisin type and in particular proteases obtained from Bacillus lentus. Of particular interest in this connection are enzyme mixtures, for example mixtures of protease and amylase or protease and lipase or lipolytic enzymes or protease and cellulase or mixtures of cellulase and lipase or lipolytic enzymes or mixtures of protease, amylase and lipase or lipolytic enzymes or protease, lipase or lipolytic enzymes and cellulase, but in particular protease and/or lipase-containing mixtures, or mixtures containing lipolytic enzymes. Examples of lipolytic enzymes of this kind are the known cutinases. Peroxidases or oxidases have also proven to be suitable in some cases. Suitable amylases include, in particular, α-amylases, isoamylases, pullulanases and pectinases. The cellulases used are preferably cellobiohydrolases, endoglucanases and β-glucosidases, which are also called cellobiases, or mixtures thereof. Since different cellulase types differ in their CMCase and avicelase activities, it is possible to adjust the desired activities by targeted mixing of the cellulases.

The enzymes can be adsorbed on carrier substances or embedded into enveloping substances in order to protect them from premature decomposition. The proportion of enzymes, enzyme mixtures or enzyme granules can, for example, be from about 0.1 to 5% by weight, preferably 0.12 to about 2% by weight.

The electrolytes from the group of inorganic salts used can be a large number of very different salts. Preferred cations are the alkali metals and alkaline earth metals, preferred anions are the halides and sulfates. From a preparation point of view, the use of NaCl or $MgCl_2$ in the compositions according to the invention is preferred. The proportion of electrolytes in the compositions according to the invention is usually 0.5 to 5% by weight.

Nonaqueous solvents which can be used in the compositions according to the invention originate, for example, from the group of mono- or polyhydric alcohols, alkanolamines or glycol ethers, provided they are miscible with water in the given concentration range. The solvents are preferably chosen from ethanol, n- or i-propanol, butanols, glycol, propane- or butanediol, glycerol, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol monomethyl or -ethyl ether, diisopropylene glycol monomethyl or -ethyl ether, methoxy-, ethoxy- or butoxytriglycol, 1-butoxyethoxy-2-propanol, 3-methyl-3-methoxybutanol, propylene glycol t-butyl ether and mixtures of these solvents. Nonaqueous solvents can be used in the liquid detergents according to the invention in amounts between 0.5 and 10% by weight, but preferably below 5% by weight and in particular below 3% by weight.

In order to bring the pH of the compositions according to the invention into the desired range, it is possible to use pH regulators. Use can be made here of any known acids or alkalis, provided their use is not precluded for application or ecological reasons or for reasons of consumer protection. The amount of these regulators does not usually exceed 5% by weight of the total formulation.

In order to improve the esthetic impression of the compositions according to the invention, they can be colored with suitable dyes. Preferred dyes, the choice of which does not present any problems at all to the person skilled in the art, have high storage stability and high insensitivity toward the other ingredients of the compositions and toward light, and do not have marked substantivity toward textile fibers in order not to dye these.

Suitable foam inhibitors which can be used in the compositions according to the invention are, for example, soaps, paraffins or silicone oils which can optionally be deposited on carrier materials. Suitable antiredeposition agents, which are also referred to as soil repellents, are, for example, nonionic cellulose ethers, such as methylcellulose and methyl-hydroxypropylcellulose having a proportion of methoxy groups of from 15 to 30% by weight and of hydroxypropyl groups of from 1 to 15% by weight, in each case based on the nonionic cellulose ethers, and the polymers, known from the prior art, of phthalic acid and/or terephthalic acid or derivatives thereof, in particular polymers of ethylene terephthalates and/or polyethylene glycol terephthalates or anionically and/or nonionically modified derivatives thereof. Of these, particular preference is given to the sulfonated derivatives of phthalic acid and terephthalic acid polymers.

Optical brighteners can be added to the compositions according to the invention in order to eliminate graying and yellowing of the treated textiles. These substances attach to the fibers and effect a brightening and simulated bleaching action by converting invisible ultraviolet radiation into visible longer-wavelength light, the ultraviolet light absorbed from sunlight being irradiated as a pale bluish fluorescence and, together with the yellow shade of the grayed or yellowed laundry, producing pure white. Suitable compounds originate, for example, from the classes of substance of 4,4'-diamino-2,2'-stilbene-disulfonic acids (flavonic acids), 4,4'-distyrylbiphenylene, methylumbelliferones, coumarins, dihydroquinolinones, 1,3-diarylpyrazolines, naphthalimides, benzoxazole, benzisoxazole and benzimidazole systems, and pyrene derivatives substituted by heterocycles. The optical brighteners are usually used in amounts between 0.05 and 0.3% by weight, based on the finished composition.

Graying inhibitors have the task of holding the soil detached from the fiber in suspended form in the liquor, thus preventing soil reattachment. Suitable for this purpose are water-soluble colloids, mostly of an organic nature, for example glue, gelatin, salts of ether sulfonic acids of starch or of cellulose or salts of acidic sulfuric esters of cellulose or of starch. Water-soluble polyamides which contain acidic groups are suitable for this purpose. In addition, it is possible to use soluble starch preparations, and starch products other than those mentioned above, e.g. degraded starch, aldehyde starches, etc. It is also possible to use polyvinylpyrrolidone. Preference is, however, given to using cellulose ethers, such as carboxymethylcellulose (Na salt), methylcellulose, hydroxyalkylcellulose and mixed ethers, such as methylhydroxyethylcellulose, methylhydroxypropylcellulose, methylcarboxymethylcellulose and mixtures thereof in amounts of from 0.1 to 5% by weight, based on the compositions.

Since textile sheet materials, in particular those made of rayon, viscose, cotton and mixtures thereof, can tend to crease because the individual fibers are sensitive to bending, kinking, pressing, and squashing transversely to the direction of the fibers, the compositions according to the invention can comprise synthetic anticrease agents. These include, for example, synthetic products based on fatty acids, fatty acid esters, fatty acid amides, fatty acid alkylol esters, fatty acid alkylolamides or fatty alcohols, which are mostly reacted with ethylene oxide, or products based on lecithin or modified phosphoric esters.

To control microorganisms, the compositions according to the invention can comprise antimicrobial active ingredients. A distinction is drawn here, depending on the antimicrobial spectrum and effectivity mechanism, between bacteriostats and bactericides, fungistats and fungicides etc. Important substances from these groups are, for example, benzalkonium chlorides, alkylaryl sulfonates, halogenated phenols and phenol mercuriacetate, it also being possible to dispense with these compounds completely in the case of the compositions according to the invention.

In order to prevent undesired changes to the compositions and/or the treated textiles caused by the effect of oxygen and other oxidative processes, the compositions can comprise antioxidants. This class of compound includes, for example, substituted phenols, hydroquinones, pyrocatechols and aromatic amines, and organic sulfides, polysulfides, dithiocarbamates, phosphites and phosphonates.

Increased wear comfort can result from the additional use of antistats which are additionally added to the compositions according to the invention. Antistats increase the surface conductivity and thus permit an improved flow of charges formed. External antistats are usually substances having at least one hydrophilic molecular ligand and produce a more or less hygroscopic film on the surfaces. These mostly surface-active antistats can be subdivided into nitrogen-containing antistats (amines, amides, quaternary ammonium compounds), phosphorus-containing antistats (phosphoric esters) and sulfur-containing antistats (alkylsulfonates, alkyl sulfates) External antistats are described, for example, in the Patent Applications FR 1,156,513, GB 873 214 and GB 839 407. The lauryl-(or stearyl-) dimethylbenzylammonium chlorides disclosed therein are suitable as antistats for textiles or as additives for detergents, a softening effect additionally being achieved.

To improve the water absorption capacity, the rewettability of the treated textiles, and to facilitate ironing of the treated textiles, silicone derivatives, for example, can be used in the compositions according to the invention. These additionally improve the rinse-out behavior of the compositions according to the invention by their foam-inhibiting properties. Preferred silicone derivatives are , for example, polydialkyl- or alkylarylsiloxanes in which the alkyl groups have one to five carbon atoms and are completely or partially fluorinated. Preferred silicones are polydimethylsiloxanes which can optionally be derivatized and then are amino-functional or quaternized, or have Si—OH, Si—H and/or Si—Cl bonds. The viscosities of the preferred silicones are, at 25° C., in the range between 100 and 100,000 mPas, it being possible to use the silicones in amounts between 0.2 and 5% by weight, based on the total composition.

Finally, the compositions according to the invention can also comprise UV absorbers, which attach to the treated textiles and improve the light resistance of the fibers. Compounds which have these desired properties are, for example, the compounds and derivatives of benzophenone having substituents in the 2- and/or 4-position which are effective by nonradiative deactivation. Furthermore, substituted benzotriazoles, acrylates phenyl-substituted in the 3-position (cinnamic acid derivatives), optionally with cyano groups in the 2-position, salicylates, organic Ni complexes, and natural substances such as umbelliferone and endogenous urocanic acid, are also suitable.

In order to avoid the decomposition of certain detergent ingredients catalyzed by heavy metals, it is possible to use substances which form complexes with the heavy metal. Suitable heavy metal complexing agents are, for example, the alkali metal salts of ethylene-diaminetetraacetic acid (EDTA) or of nitrilotriacetic acid (NTA), and alkali metal salts of anionic polyelectrolytes, such as polymaleates and polysulfonates.

A preferred class of complexing agents are the phosphonates, which are present in preferred liquid detergents in amounts of from 0.01 to 1.5% by weight, preferably from 0.02 to 1% by weight and in particular from 0.03 to 0.5% by weight. These preferred compounds include, in particular, organophosphonates, such as, for example, 1-hydroxyethane-1,1-diphosphonic acid (HEDP), aminotri (methylenephosphonic acid) (ATMP), diethylenetriaminepenta(methylenephosphonic acid) (DTPMP or DETPMP), and 2-phosphonobutane-1,2,4-tricarboxylic -acid (PBS-AM), which are used in most cases in the form of their ammonium or alkali metal salts.

Particularly preferred liquid detergents comprise, as component c) of the thickening system, 1-hydroxyethane-1,1-diphosphonic acid in the form of its ammonium or alkali metal salts.

The compositions according to the invention are prepared by simply mixing the constituents in stirred-tank reactors, water, nonaqueous solvents and surfactant(s) advantageously being introduced first, and the other constituents being added in portions thereto. Separate heating during the preparation is not required, but if it is desired, the temperature of the mixture should not exceed 80° C.

EXAMPLES

By mixing the individual constituents, the liquid detergents E1 and E2 according to the invention, and the comparative examples V1 to V4 were prepared, the composition of which is given in Table 1.

TABLE 1

| | Liquid detergent [% by wt.] | | | | | |
|---|---|---|---|---|---|---|
| | V1 | V2 | V3 | V4 | E1 | E2 |
| $C_{12-14}$-fatty alcohol with 7 EO | 10.00 | 10.00 | 10.00 | 10.00 | 10.00 | 10.00 |
| $C_{12-14}$-fatty alcohol sulfate, Na salt | 4.50 | 4.50 | 4.50 | 4.50 | 4.50 | 4.50 |
| $C_{12-18}$-fatty acid, Na salt | 13.00 | 13.00 | 13.00 | 13.00 | 13.00 | 13.00 |
| $C_{12-14}$-alkyl polyglycoside | 1.50 | 1.50 | 1.50 | 1.50 | 1.50 | 1.50 |
| Boric acid | 1.00 | 1.00 | 1.00 | — | 1.00 | 1.00 |
| Sodium citrate | 4.00 | 4.00 | 4.00 | 4.00 | 4.00 | 4.00 |
| Dequest ® 2016 D | 0.03 | 0.03 | 0.03 | — | 0.03 | — |
| Carbopol ® ETD 2690 | 0.50 | — | — | — | — | — |
| Keltrol ® T | — | 0.50 | — | — | — | — |
| Rhodopol ® 50 MD | — | — | 0.50 | — | — | |
| Acusol ® 820 | — | — | — | 0.50 | 0.50 | 0.50 |
| Water | to 100 | to 100 | to 100 | to 100 | to 100 | to 100 |

The amounts given in Table 1 refer to active substance

| | |
|---|---|
| Dequest ® 2016 D: | Hydroxyethane-1,1-diphosphonic acid, tetrasodium salt (Monsanto) |
| Carbopol ® ETD 2690: | Acrylic acid copolymer and monomers (Goodrich) |
| Keltrol ® T: | Xanthan gum, polysaccharide (Kelco) |
| Rhodopol ® 50 MD: | Xanthan gum (Rhône-Poulenc) |
| Acusol ® 820 | Methacrylic acid (stearyl alcohol-20-EO) ester-acrylic acid copolymer (Rohm & Haas) |

To test the storage stability, the liquid detergents were stored for 16 weeks under various climatic conditions, and their appearance was assessed visually. The results of this asessment are given in Table 2.

TABLE 2

| | Product appearance after 16 weeks | | | | | |
|---|---|---|---|---|---|---|
| | V1 | V2 | V3 | V4 | E1 | E2 |
| Summer climate (25–40° C.) | Phase separation | Phase separation | Phase separation | slight phase separation significant agglomeration | no change | no change |
| Fall climate (10–30° C.) | Phase separation | Phase separation | Phase separation | slight phase separation significant agglomeration | no change | no change |
| Winter climate (0–10° C.) | Phase separation | Phase separation | Phase separation | slight phase separation significant agglomeration | no change | no change |

As a result of considerable phase separation in comparative examples V1, V2 and V3, the only way in which the viscosity values of these compositions could be recorded was to mix the two phases by shaking and to measure the viscosity. These viscosities and the values of E1, E2 and V4 after preparation and after storage for 16 weeks under various climatic conditions are given in Table 3:

TABLE 3

| | Viscosity after preparation and after storage for 16 weeks [mPas] | | | | | |
|---|---|---|---|---|---|---|
| | V1 | V2 | V3 | V4 | E1 | E2 |
| After preparation | 1850 | 1900 | 1870 | 1800 | 1970 | 1980 |
| Summer climate (25–40° C.) | 1100 | 1020 | 1200 | 1790 | 2050 | 2000 |
| Fall climate (10–30° C.) | 1080 | 1130 | 1090 | 1680 | 2080 | 2040 |
| Winter climate (0–10° C.) | 1200 | 1210 | 1180 | 1700 | 1940 | 1960 |

What is claimed is:

1. An aqueous, highly viscous liquid detergent with a thickening system comprising, based on the weight of the total composition:

a) 0.2 to 5% by weight of one or both of a polyurethane of the formula I

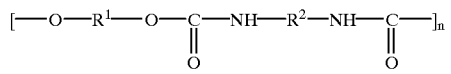

I wherein $R^1$ is a linear or branched $C_{2-12}$-alk(en)yl or polyetherdiol group, $R^2$ is an aliphatic or aromatic group, and n is a natural number, or a modified polyacrylate polymer or copolymer of the formula II wherein

II

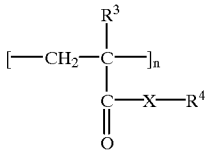

$R^3$ is H or a branched or unbranched $C_{1-4}$-alk(en)yl radical, X' is N—$R^5$ or O, $R^4$ is an optionally alkoxylated, branched or unbranched, optionally substituted $C_{8-22}$-alk(en)yl radical, $R^5$ is H or $R^4$, and n is a natural number;

b) 0.5 to 7% by weight of a boron compound; and c) 1 to 8% by weight of a complexing agent or agents.

2. The aqueous liquid detergent as claimed in claim 1, wherein the detergent further comprises 30% by weight of surfactant(s), based on the total weight of the composition.

3. The aqueous liquid detergent as claimed in claim 1, wherein component a) comprises 0.2 to 4% by weight of the polyurethane, based on the total weight of the composition.

4. The aqueous liquid detergent as claimed in claim 3, wherein component a) comprises 0.3 to 3% by weight of the polyurethane, based on the total weight of the composition.

5. The aqueous liquid detergent as claimed in claim 4, wherein component a) comprises 0.5 to 1.5% by weight of the polyurethane, based on the total weight of the composition.

6. The aqueous liquid detergent as claimed in claim 1, wherein component b) comprises 0.5 to 4% by weight of one or both of boric acid or sodium tetraborate, based on the total weight of the composition.

7. The aqueous liquid detergent as claimed in claim 6, wherein component b) comprises 0.75 to 3% by weight of one or both of boric acid or sodium tetraborate, based on the total weight of the composition.

8. The aqueous liquid detergent as claimed in claim 7, wherein component b) comprises 1 to 2% by weight of one or both of boric acid or sodium tetraborate, based on the total weight of the composition.

9. The aqueous liquid detergent as claimed in claim 1, wherein component c) comprises one or both of citric acid or sodium citrate.

10. The aqueous liquid detergent as claimed in claim 9, wherein component c) comprises 2 to 7.5% by weight of sodium citrate, based on the total weight of the composition.

11. The aqueous liquid detergent as claimed in claim 10, wherein component c) comprises 3 to 6% by weight of sodium citrate, based on the total weight of the composition.

12. The aqueous liquid detergent as claimed in claim 11, wherein component c) comprises 4 to 5% by weight of sodium citrate, based on the total weight of the composition.

13. The aqueous liquid detergent as claimed in claim 1, wherein the detergent further comprises 5 to 20% by weight of nonionic surfactants, based on the total weight of the composition.

14. The aqueous liquid detergent as claimed in claim 13, wherein the detergent further comprises 7 to 15% by weight of nonionic surfactants, based on the total weight of the composition.

15. The aqueous liquid detergent as claimed in claim 14, wherein the detergent further comprises 9 to 14% by weight of nonionic surfactants, based on the total weight of the composition.

16. The aqueous liquid detergent as claimed in claim 1, wherein the detergent further comprises 5 to 25% by weight of anionic surfactants, based on the total weight of the composition.

17. The aqueous liquid detergent as claimed in claim 16, wherein the detergent further comprises 7 to 22% by weight of anionic surfactants, based on the total weight of the composition.

18. The aqueous liquid detergent as claimed in claim 17, wherein the detergent further comprises 10 to 20% by weight of anionic surfactants, based on the total weight of the composition.

19. The aqueous liquid detergent as claimed in claim 1, wherein the detergent has a viscosity from 500 to 5000 mpas.

20. The aqueous liquid detergent as claimed in claim 19, wherein the detergent has a viscosity from 1000 to 4000 mpas.

21. The aqueous liquid detergent as claimed in claim 20, wherein the detergent has a viscosity from 1300 to 3000 mpas.

22. The aqueous liquid detergent as claimed in claim 1, wherein the detergent further comprises one or more substances selected from the group consisting of builders, bleaches, bleach activators, enzymes, electrolytes, nonaqueous solvents, pH regulators, fragrances, perfume carriers, fluorescence agents, dyes, hydrotropic agents, foam inhibitors, silicone oils, antiredeposition agents, optical brighteners, graying inhibitors, shrink preventatives, anticrease agents, dye-transfer inhibitors, antimicrobial active ingredients, germicides, fungicides, antioxidants, corrosion inhibitors, antistats, easy-iron agents, repellent and impregnation agents, swelling and nonslip agents, and UV absorbers.

23. The aqueous liquid detergent as claimed in claim 1, wherein the detergent further comprises 0.01 to 1.5% by weight of a phosphonate, based on the total weight of the composition.

24. The aqueous liquid detergent as claimed in claim 23, wherein the detergent further comprises 0.02 to 1% by weight of a phosphonate, based on the total weight of the composition.

25. The aqueous liquid detergent as claimed in claim 1, wherein component a) comprises 0.2 to 4% of the polyacrylate.

26. The aqueous liquid detergent as claimed in claim 25, wherein component a) comprises 0.3 to 3% of the polyacrylate.

27. The aqueous liquid detergent as claimed in claim 26, wherein component a) comprises or 0.5 to 1.5% by weight of the polyacrylate.

28. The aqueous liquid detergent as claimed in claim 1, wherein the detergent further comprises 0.03 to 0.5% by weight of a phosphonate, based on the total weight of the composition.

29. The aqueous liquid detergent as claimed in claim 1, wherein the modified polyacrylate comprises a polyacrylate-polymethacrylate copolymer of the formula IIa IIa
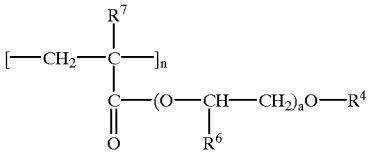
wherein $R^4$ is a branched or unbranched, saturated or unsaturated $C_{8-22}$-alk(en)yl radical, $R^6$ and $R^6$ are independently H or $CH_3$, n is a natural number, and a is a natural number of 2 to 30.
30. The aqueous liquid detergent as claimed in claim 29, wherein $R^4$ is a fatty alcohol radical, $R^6$ is H, and a is a natural number of 10 to 20.
* * * * *